US005941430A

United States Patent [19]

Kuwabara

[11] Patent Number: 5,941,430

[45] Date of Patent: Aug. 24, 1999

[54] HOLDER FOR SEWING NEEDLES

[75] Inventor: Junichi Kuwabara, Osaka, Japan

[73] Assignee: Clover Mfg. Co., Ltd., Osaka, Japan

[21] Appl. No.: 08/970,602

[22] Filed: Nov. 14, 1997

[30] Foreign Application Priority Data

Mar. 10, 1997 [JP] Japan ..... 9-054809
May 6, 1997 [JP] Japan ..... 9-115735

[51] Int. Cl.[6] ..... A41H 31/00; B65D 85/28

[52] U.S. Cl. ..... 223/109 R; 206/380; 206/382; 206/383

[58] Field of Search ..... 223/109 R, 108, 223/106; 206/380, 382, 383

[56] References Cited

U.S. PATENT DOCUMENTS 2,573,311 10/1951 Cupler, II ..... 206/382
2,771,990 11/1956 Buschkamper ..... 206/382
3,603,492 9/1971 Schartz ..... 223/109 R
4,116,333 9/1978 Pavel ..... 223/109 R
4,524,891 6/1985 Silva ..... 223/109 R

FOREIGN PATENT DOCUMENTS 256844 2/1913 Germany ..... 223/109 R

*Primary Examiner*—Bibhu Mohanty
*Attorney, Agent, or Firm*—Merchant & Gould P.C.

[57] ABSTRACT

A holder for sewing needles with thread is provided which includes a reel having an end plate and a winding member for winding the thread. The holder further includes a retaining member, such as a pin cushion, for positioning each needle relative to the end plate. The holder also has a base for supporting the reel for rotational movement. The base is formed with an upright wall enclosing but spaced from the winding member to provide a clearance between the upright wall and the winding member. The upright wall is formed with a slit through which the thread of the needle is brought into the above-mentioned clearance while the reel is rotated.

15 Claims, 10 Drawing Sheets

HOLDER FOR SEWING NEEDLES

BACKGROUND OF THE INVENTION

1. Field of the Invention

The present invention relates to a holder for sewing needles. In particular, the present invention relates to a portable needle holder suitable for retaining thread-attached sewing needles.

2. Description of the Related Art

When not in use, sewing needles may often be stuck in a soft retainer such as a pin cushion. When a user intends to take the needle-stuck cushion with him or her on a journey for example, the cushion needs to be put in a suitable container such as a protection box so that the user is protected from possible injury caused by the needles. However, such a box tends to be rather bulky or cumbersome to be carried. Thus, conventionally, portable needle holders suitably carried in a bag are widely used. However, such a conventional needle holder is merely a hollow case with no retaining cushion provided. Thus, sewing needles are freely movable in the holder. As a result, the conventional holder suffers the following disadvantage.

Specifically, it is assumed that a suitable length of thread is attached to a needle to be carried in the holder. As described above, the needle (and the thread as well) is movable in the holder. Thus, the thread of the needle will unfavorably be entangled with itself or the needle in a complicated manner. Obviously, such an inconvenient situation will be aggravated when a plurality of needles with thread are put together in the holder.

SUMMARY OF THE INVENTION

It is, therefore, an object of the present invention to provide a holder for sewing needles that overcomes the above problem.

According to the present invention, there is provided a holder for sewing needles each being coupled with thread. The holder of the present invention includes a reel having an end plate and a winding member for winding the thread. The winding member extends from the end plate. The holder further includes a retaining member for positioning each needle relative to the end plate, and a base supporting the reel for rotational movement. The base is provided with a first wall enclosing but spaced from the winding member to provide a clearance between the first wall and the winding member. The first wall is formed with a first opening through which the thread of the needle is brought into the above-mentioned clearance while the reel is rotated.

The end plate may include a flanged portion formed with cutouts for receiving the thread of the needles.

The first wall may include first and second end portions flanking the first opening. The reel is rotated in a direction advancing along the first end portion, the first opening and the second end portion in this order. The second end portion is bent in a radially outward direction.

The holder may further include restricting means for permitting the reel to rotate in one direction only. The restricting means may be made up of a ratchet mechanism.

The retaining member may be a pin cushion held within the reel.

The end plate of the reel may be provided with a plurality of thread-guiding grooves. Each groove may have a bore to communicate with the retaining member.

Each thread-guiding groove may have a longitudinal axis positionally deviated from a radial direction of the reel.

The end plate of the reel may be diametrically larger than the first wall. Each cutout of the flanged portion may extend radially inward beyond the first wall.

Preferably, the winding member of the reel may be provided with a plurality of raised portions each extending axially of the winding member.

The base may further include an inner wall between the first wall and the winding member. The inner wall may be formed with a guiding groove which is circumferentially deviated from the first opening of the first wall.

The holder of the present invention may further includes a protection cover releasably attached to the base. The base may include an outer wall enclosing but spaced outward from the first wall. In such a case, the protection cover may be attached to the base between the outer wall and the intermediate wall. The outer wall may be formed with a second opening through which the thread of a needle is entered.

Other objects, features and advantages of the present invention will be fully understood from the following detailed description given with reference to the accompanying drawings.

DETAILED DESCRIPTION OF THE PREFERRED EMBODIMENTS

Preferred embodiments of the present invention will be described below with reference to the accompanying drawings.

Figure 1:
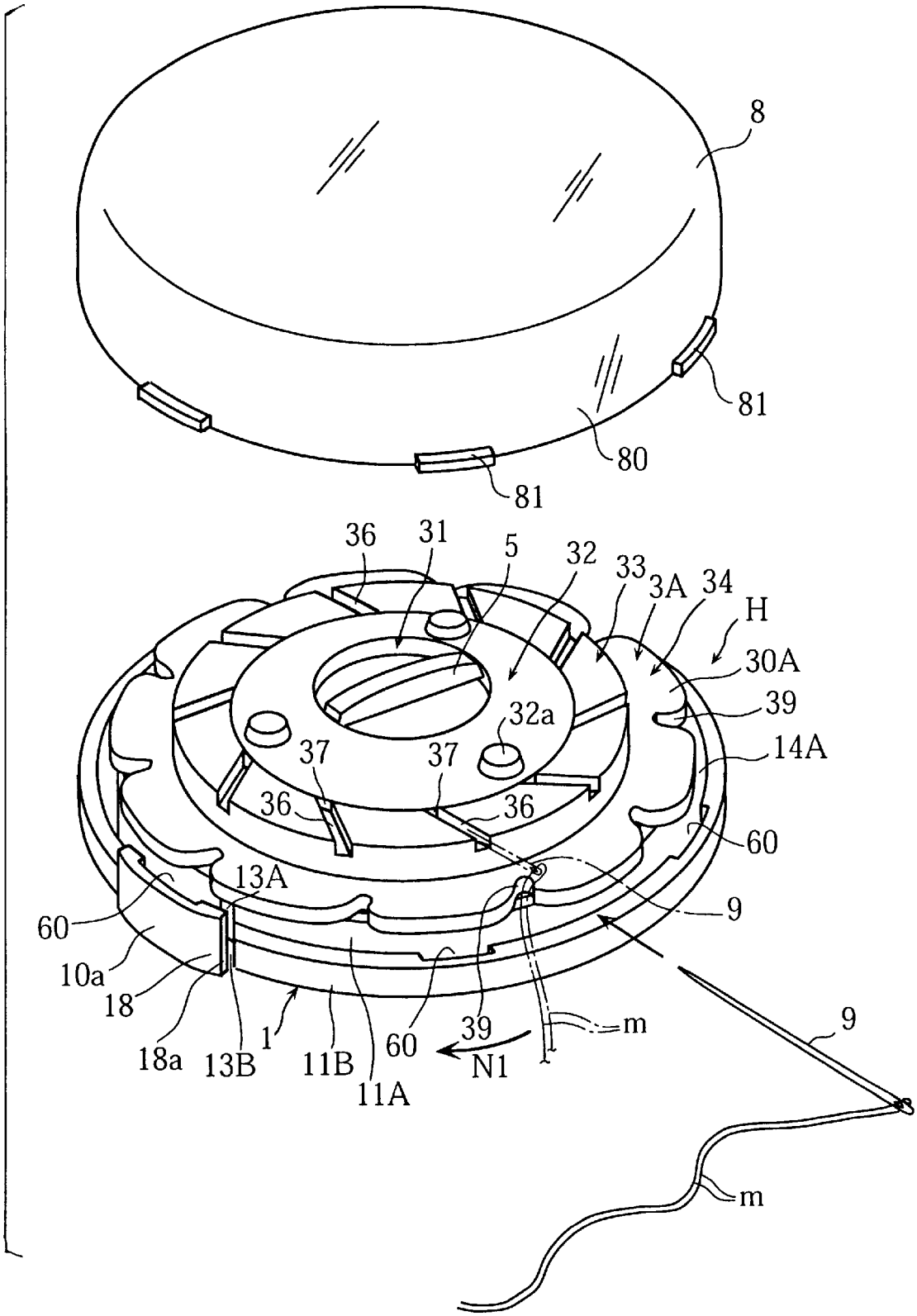
FIG. 1 is a perspective view showing a holder for sewing needles according to a first embodiment of the present invention.

FIG. 1 schematically shows a needle holder according to a first embodiment of the present invention. The illustrated holder includes a holding body H and a protection cover 8. Though FIG. 1 shows only one needle 9 for simplicity of explanation, the holder of the present invention is advantageously used for a plurality of sewing needles.

Figure 2:
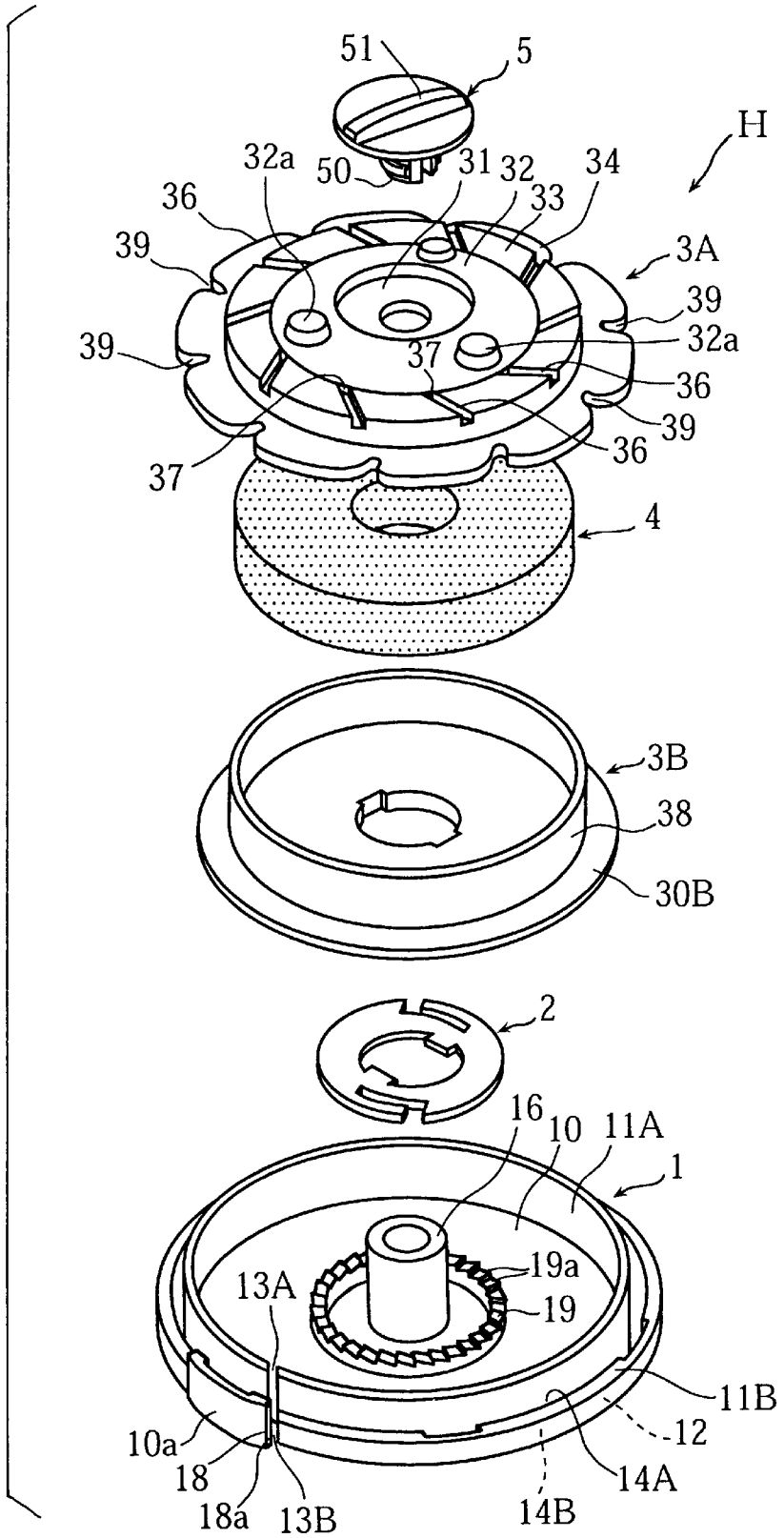
FIG. 2 is an exploded view of the same holder.

Referring to FIG. 2, the holding body H is made up of a base 1, a ratchet ring 2, an end plate 3A, a spool 3B, a pin cushion 4 and an attachment 5. In use, the spool 3B is fixed to the end plate 3A to allow no relative movement therebetween. The combination of the end plate 3A and the spool 3B will be referred to as a reel hereinafter. The pin cushion 4 may be made of a comparatively soft material such as felt, whereas the other elements may be made of a suitably hard material such as a synthetic resin for example.

Figure 3:
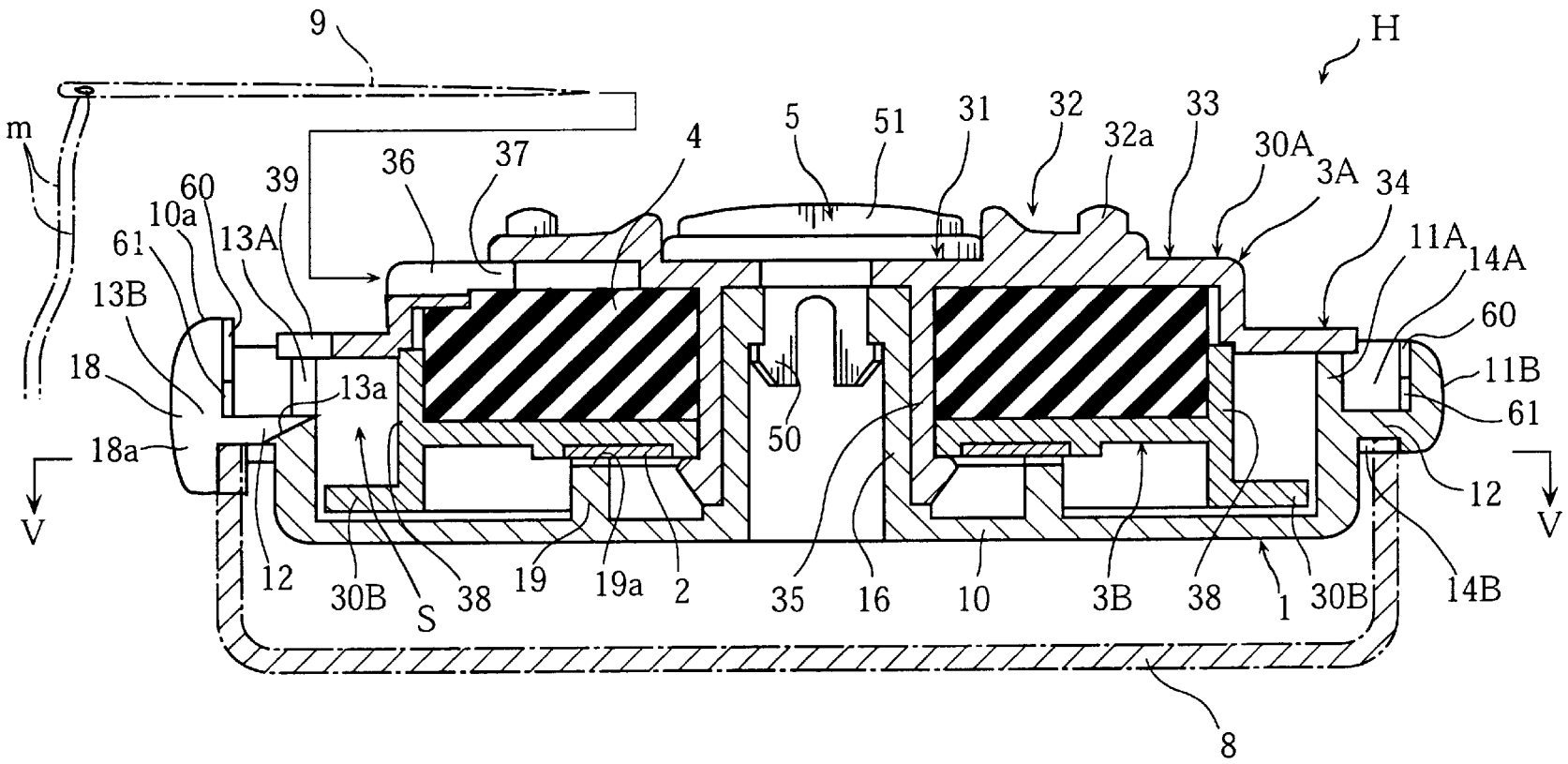
FIG. 3 is a sectional view schematically illustrating the same holder.

As seen from FIGS. 2 and 3, the base 1 includes a generally circular bottom 10, an intermediate wall 11A and an outer wall 11B. The intermediate wall 11A extends upright from the periphery of the bottom 10. The outer wall 11B, which is also perpendicular to the bottom 10, is connected to the intermediate wall 11A via a horizontal connecting portion 12 (see FIG. 3) in a manner such that a first fixing groove 14A and a second fixing groove 14B are formed above and below the connecting portion 12, respectively. The first and second fixing grooves are used for fixing the rim of the protection cover 8, as will be described hereinafter.

The intermediate wall 11A is formed with a first opening or slit 13A. The first opening 13A extends through the thickness of the intermediate wall 11A and is open upward. Similarly, the outer wall 11B is formed with a second opening 13B. The second opening 13B extends through the thickness of the outer wall 11B and is open upward.

Figure 4:
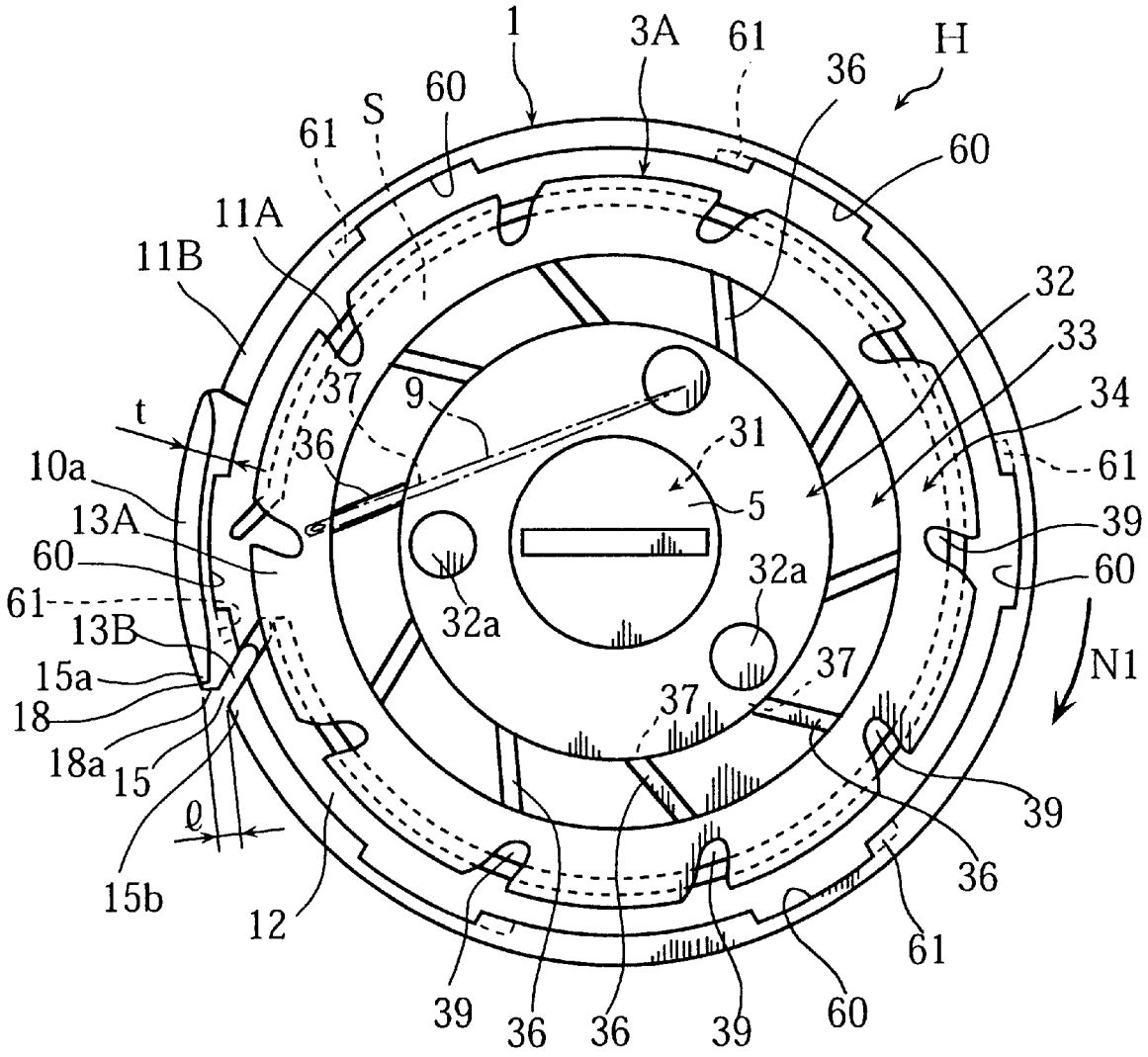
FIG. 4 is a plan view of the same holder.

As shown in FIG. 4, the second opening 13B is located adjacent to but circumferentially deviated from the first opening 11A. The second opening 13B formed in the outer wall also penetrates part of the horizontal connecting portion 12 to extend obliquely toward the first opening 13A. The radially inner end of the second opening 13B has a tapered portion 13*a* (see FIG. 3). Thus, the thread of a sewing needle is smoothly passed through the second opening 13B without being caught by the inner end of the second opening.

The outer wall 11B is provided with a thick-wall portion 10*a* on a side of the second opening 13B. The thick-wall portion has a thickness t which is greater than that of the other portions of the outer wall. Thus, of two edge portions 15*a*, 15*b* flanking the second opening 13B, the edge portion 15*a* is projected radially outward (see reference numeral 18) by an amount of l relative to the other edge portion 13*b*. The projection 18 has a side surface 18*a*.

As shown in FIG. 3, the end plate 3A includes a cylindrical member 35 extending downward from a central region of the end plate. The cylindrical member 35 is rotatably fitted around an upwardly extending cylindrical projection 16 of the base 1 (see also FIG. 2). With such an arrangement, the reel (the end plate and the spool) is rotatable relative to the base 1 about the projection 16.

In the illustrated embodiment, however, the reel is arranged to rotate in one direction only. Specifically, as shown in FIG. 2, the base 1 is formed with a circular toothed stump 19 enclosing the projection 16. The upper end of the stump 19 is provided with a plurality of teeth 19*a* like a saw. On the other hand, the ratchet ring 2 is fixed to the lower surface of the bottom of the spool 3B. The rathcet ring 2 is provided with a suitable number of pawls (two pawls in FIG. 2) which are arranged to engage the teeth 19*a* when rotated in a predetermined direction but to avoid engagement with the teeth in the opposite direction. In accompanying drawings, the rotational direction of the reel is indicated by arrow N1.

As shown in FIGS. 1–4, the end plate 3A has an upper surface 30A provided with a plurality of step portions. In the illustrated embodiment, the step portions include an innermost first region 31, a second region 32, a third region 33 and an outermost fourth region 34.

The first region 31 is a circular flat portion located below the second region 32. The circular flat portion is formed with a central through-hole. Thus, it is possible to fit the attachment 5 in the first region 5 by allowing passage of engaging members 50 of the attachment 5 via the the through-hole. Each engaging member 50 is formed at its lower end with an outwardly projecting hook. In use, the hook is brought into engagement with the inner surface of the cylindrical projection 16. In this way, the attachment 5 prevents the reel from coming off from the projection 16 of the base 1. It is also possible to release the engagement between the hook of the engaging member 50 and the inner surface of the projection 16. Specifically, the attachment 5 is arranged to be pulled out by turning a tab 51 provided on the attachment 5. After the attachment 5 is pulled out, the reel can be separated from the base 1.

The second region 32 has an upper surface higher than the first region 31. This upper surface is formed with a plurality of protrusions 32*a* spaced by an equal rotational angle. These protrusions facilitates manual rotation of the reel. It may be possible to provide a suitable number of dented portions in place of the protrusions 32*a*.

The third region 33 has a lower surface than the second region 32. According to the present invention, the upper surface of the third region 33 is provided with needle-guiding means. In the illustrated embodiment, the needle-guiding means are a plurality of grooves 32 equally spaced by a constant rotational angle. Each groove 36 has a radially inner end provided with a bore 37 to communicate with the inner space of the reel. Thus, as shown in FIG. 4, it is possible to insert the point of a needle placed in the guiding-groove into the inner space of the reel. As seen from the same figure, each guiding-groove 36 is arranged obliquely to the radial direction. As a result, the needle 9 placed in the groove 36 assumes a position outwardly spaced from the attachment 5.

The fourth region 34 has an upper surface lower than the third region 33. On the circumferential edge of the fourth region 34 are provided a plurality of cutouts 39 corresponding to the needle-guiding grooves 36. As best shown in FIGS. 3 and 4, the fourth region 34 projects slightly outward beyond the intermediate wall 11A. In other words, the end plate 3A is diametrically larger than the intermediate wall 11A. Each cutout 39 extends inward beyond the intermediate wall 11A.

As shown in FIG. 2, the spool 3B includes a cylindrical portion 38 on which the thread m of the needle 9 is wound, and a flanged portion 30B extending perpendicularly to the winding portion 38. In an assembled state, the radially outer surface of the winding portion 38 faces the radially inner surface of the intermediate wall 11A (see FIG. 3). The flanged portion 30B prevents the thread wound on the winding portion 38 from coming off downward from the winding portion 38. A thread-winding space S (see FIG. 3) is defined by the outer surface of the winding portion 38, the inner surface of the intermediate wall 11A, the lower surface of the fourth region 34 and the upper surface of the flanged portion 30B.

The pin cushion 4 is formed in a doughnut-like shape having a predetermined thickness. In use, the cushion 4 is held between the end plate 3A and the spool 3B so that an upper portion of the cushion 4 is located adjacent to the bore 37. With such an arrangement, the needle 9 to be inserted via the bore 37 of the guiding groove 36 is stuck in the cushion 4.

Referring back to FIG. 1, the protection cover 8, which may either be transparent or opaque, is arranged to be releasably fitted to the holding body H from above. Specifically, the protection cover 8 includes a circular upper covering member and a side wall 80 extending from the upper covering member. The lower rim of the side wall 80 is formed with a plurality of engaging pieces 81 spaced at predetermined intervals. The inner surface of the outer wall 11B of the base 1 is formed with a plurality of insertion cutouts 60 corresponding to the engaging pieces 81. As shown in FIG. 3, the inner surface of the outer wall 11B is also formed with an undercut groove 61 extending circumferentially of the wall 11B immediately under the insertion cutouts 60. The undercut groove 61 is arranged to communicate with the insertion cutouts 60.

With such an arrangement, the protection cover 8 is easily attached to the holding body H as follows. First, the lower rim of the side wall 80 is inserted into the first fixing groove 14A of the base 1. At this time, the engaging pieces 81 are passed through the insertion cutouts 60 into the undercut groove 61. Then, the protection cover 8 is rotated in a predetermined direction to engage the engaging pieces 81 with the undercut groove 61. As is easily understood, the above steps are performed in the reverse order to detach the protection cover 8 from the holding body H.

As indicated by single-dot chain lines in FIG. 3, the protection cover 8 of the present invention can be attached to the bottom side of the base 1. In this instance, the rim of the side wall 80 of the cover 8 is received in the second fixing groove 14B.

The function of the holder according to the first embodiment will be described below.

Figure 5:
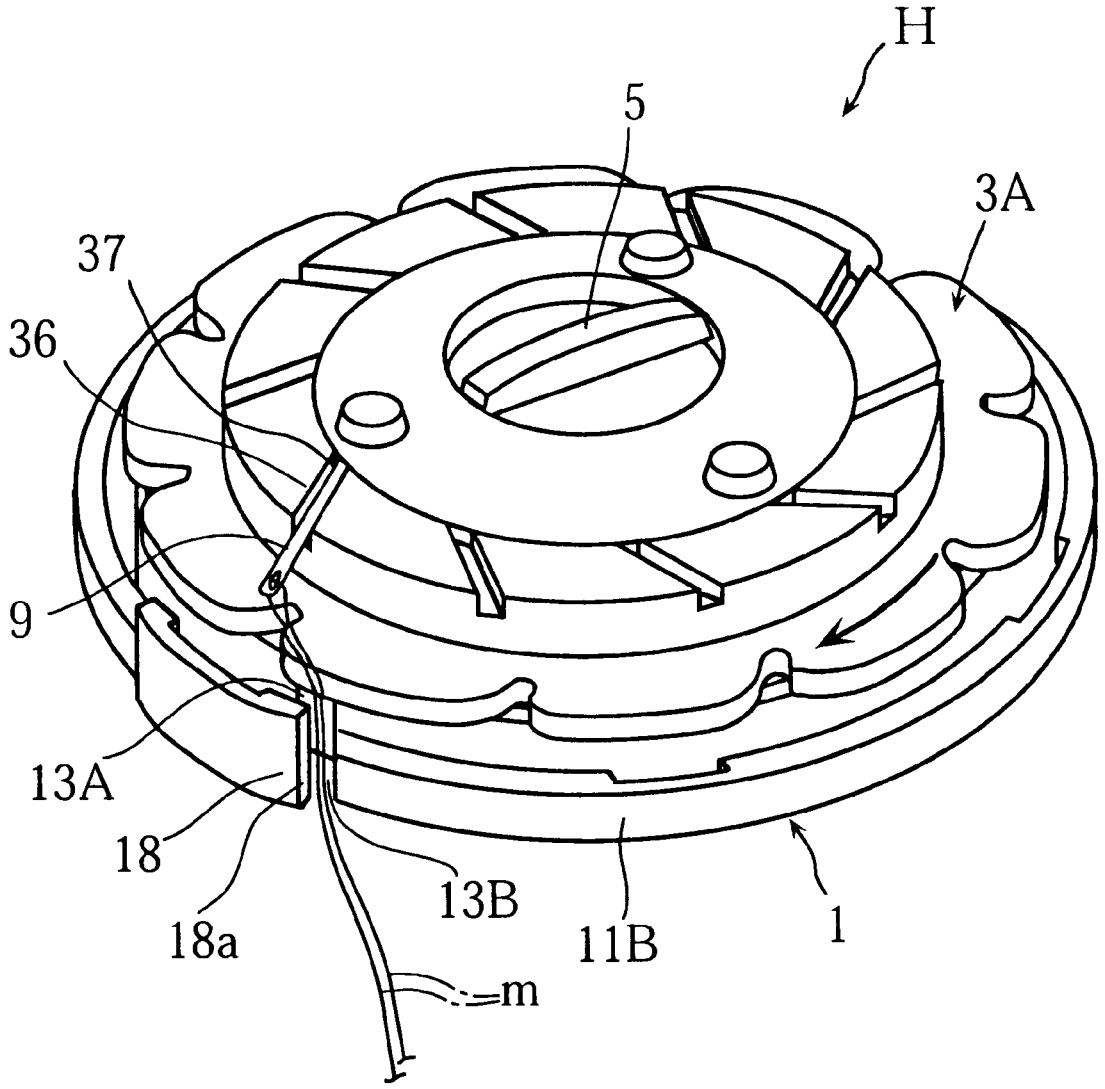
FIG. 5 is a perspective view of the same holder, in which the thread attached to the needle is brought to an opening of the outer wall.

First, the needle 9 with thread m is inserted via the bore 37 of a needle-guiding groove 36, as shown in FIG. 1. As previously described, the pin cushion 4 is held within the reel. Thus, the inserted needle 9 is stuck in the cushion 4 to be properly retained on the upper surface 30A of the end plate 3A. In this state, the needle 9 is positioned by the guiding groove 36. Then the thread m hanging from the needle 9 is brought into engagement with a cutout 39 corresponding to the guiding groove 36, as indicated by single-dot chain lines in FIG. 1. Then, the reel is rotated in the N1-direction. As a result, the needle 9 together with the thread m is rotated in the N1-direction. During this rotation, the thread m is moved along the radially outer surface of the outer wall 11B, and brought to the second opening 13B as shown in FIG. 5. Then, the thread m is guided by the side surface 18*a* of the projection 18 to be moved inwardly through the second groove 13B. Thus, according to the present invention, the thread m is brought to the second groove 13B and passed through it simply by rotating the reel.

Figure 6:
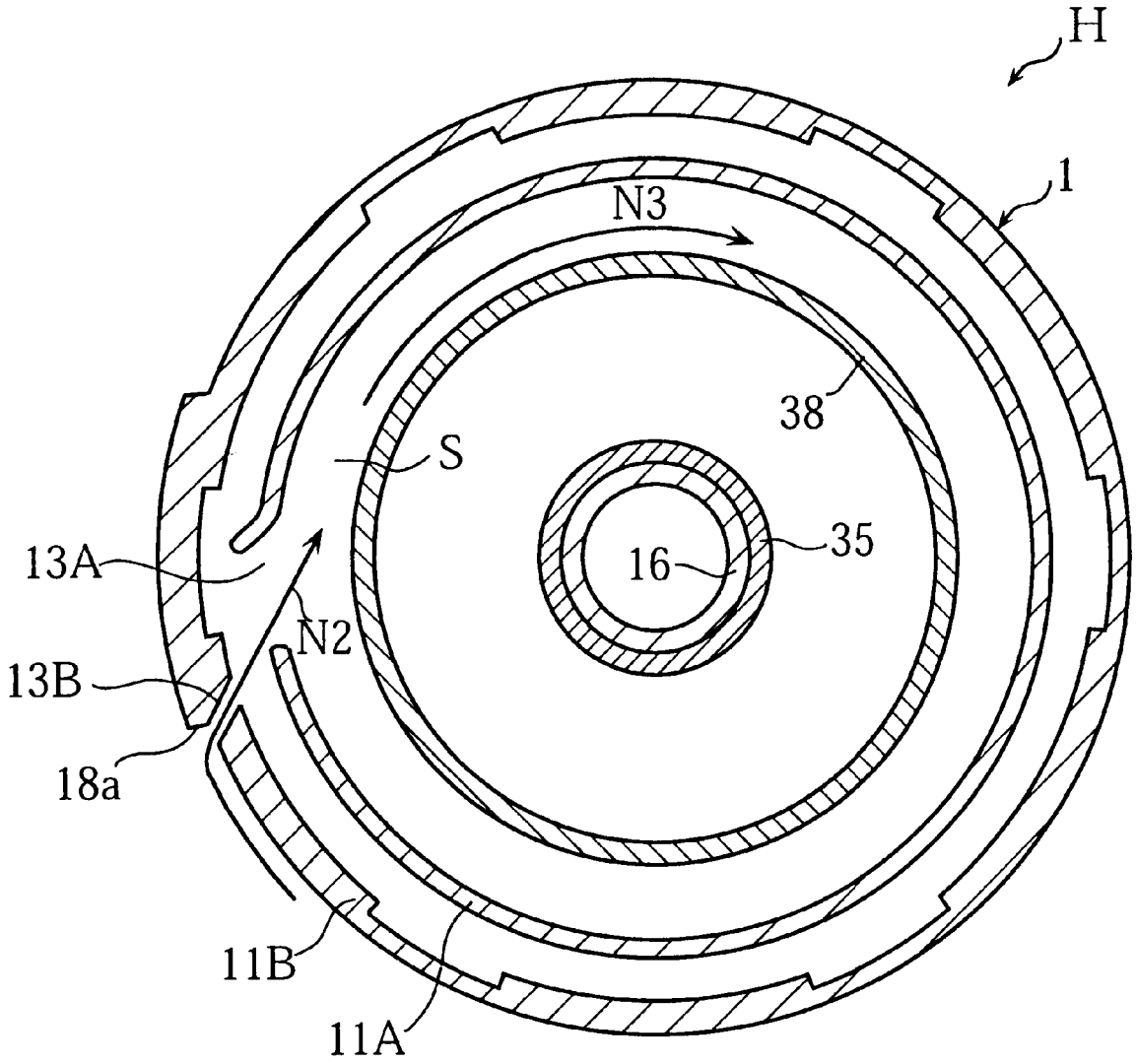
FIG. 6 is a sectional view of the same holder, in which the passage of the thread is indicated by arrows.

After the thread m is passed through the second groove 13B, the thread m is led inward toward the first groove 13A of the intermediate wall 11A, as shown in FIG. 6, with further rotation of the reel. Then, after passing through the first groove 13A, the thread m is introduced into the thread-winding space S, as indicated by an arrow N2. Then, the thread m is moved in the direction of an arrow N3 to be wound on the winding member 38 of the reel. As the rotation is continued, the entire length of the thread m is advantageously wound on the winding member 38.

As is easily understood from the above description, threads of more than one sewing needle can be conveniently wound on the winding member 38 of the spool 3B. Specifically, the threads of different needles are prevented from getting entangled with each other, since those threads are wounded on the winding member 38 in the same direction. Further, the wound threads of the respective needles 9 are kept from unduly sagging around the winding member 38 since the reel is rotated in one direction only.

When the user wishes to use a needle carried by the holder, first the selected needle is picked up from the guiding groove and drawn out fron the pin cushion 4. Then, a suitable pulling force is applied to the thread of the selected needle. By doing this, the thread of the selected needle is smoothly paid out from the reel since the thread is orderly wound on the winding member 38, as described above.

Figure 7:
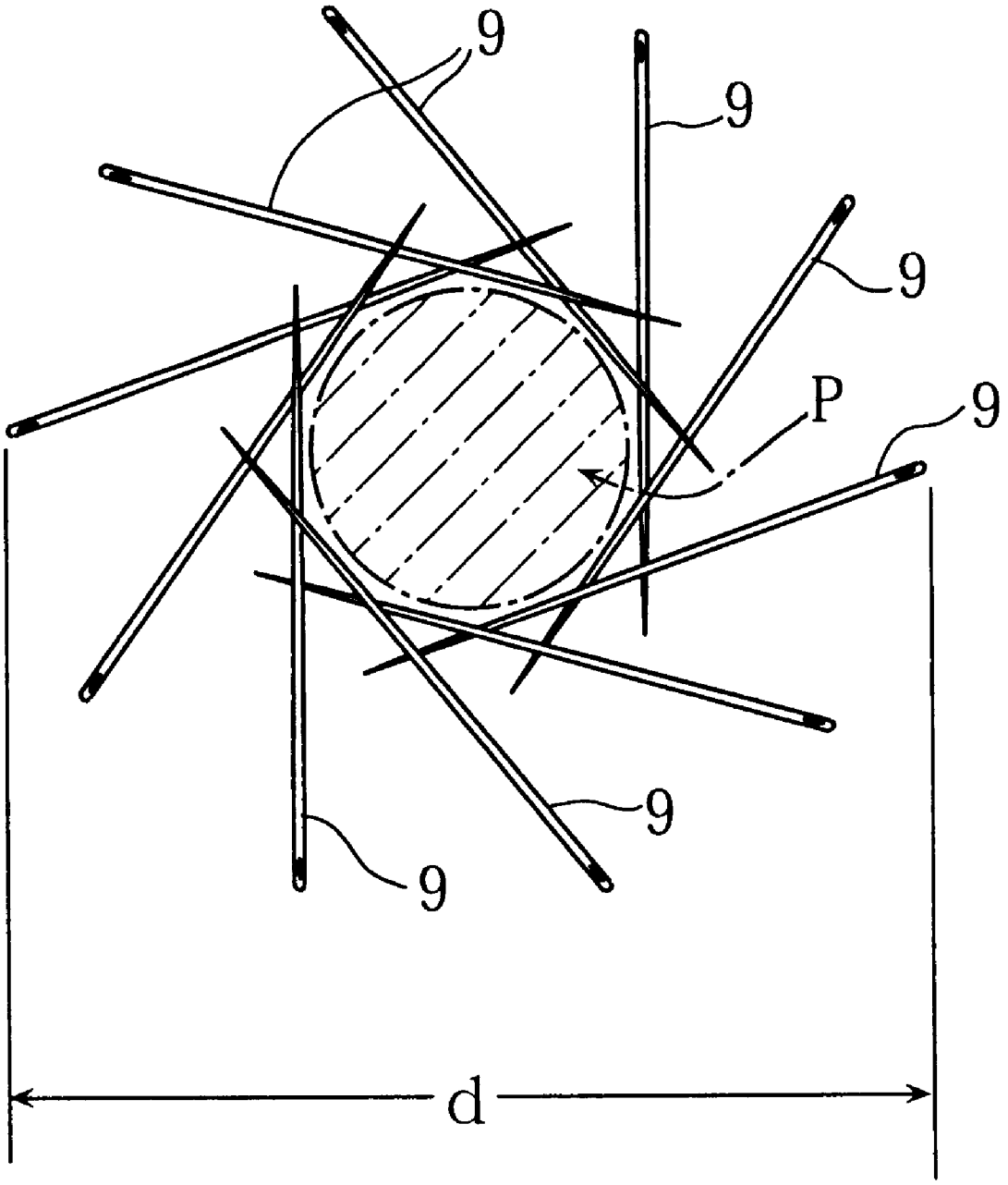
FIG. 7 illustrates a configuration of the needles arranged around a central portion of the same holder.

As previously described, the orientation of the needles 9 carried on the end plate 3A is defined by the guiding grooves 36. FIG. 7 schematically shows the configuration of the needles 9.

With such an arrangement, the maximum size d of the space taken up by the needles 9 is reduced. Consequently, the holder as a whole can be reduced in size.

Figure 8:
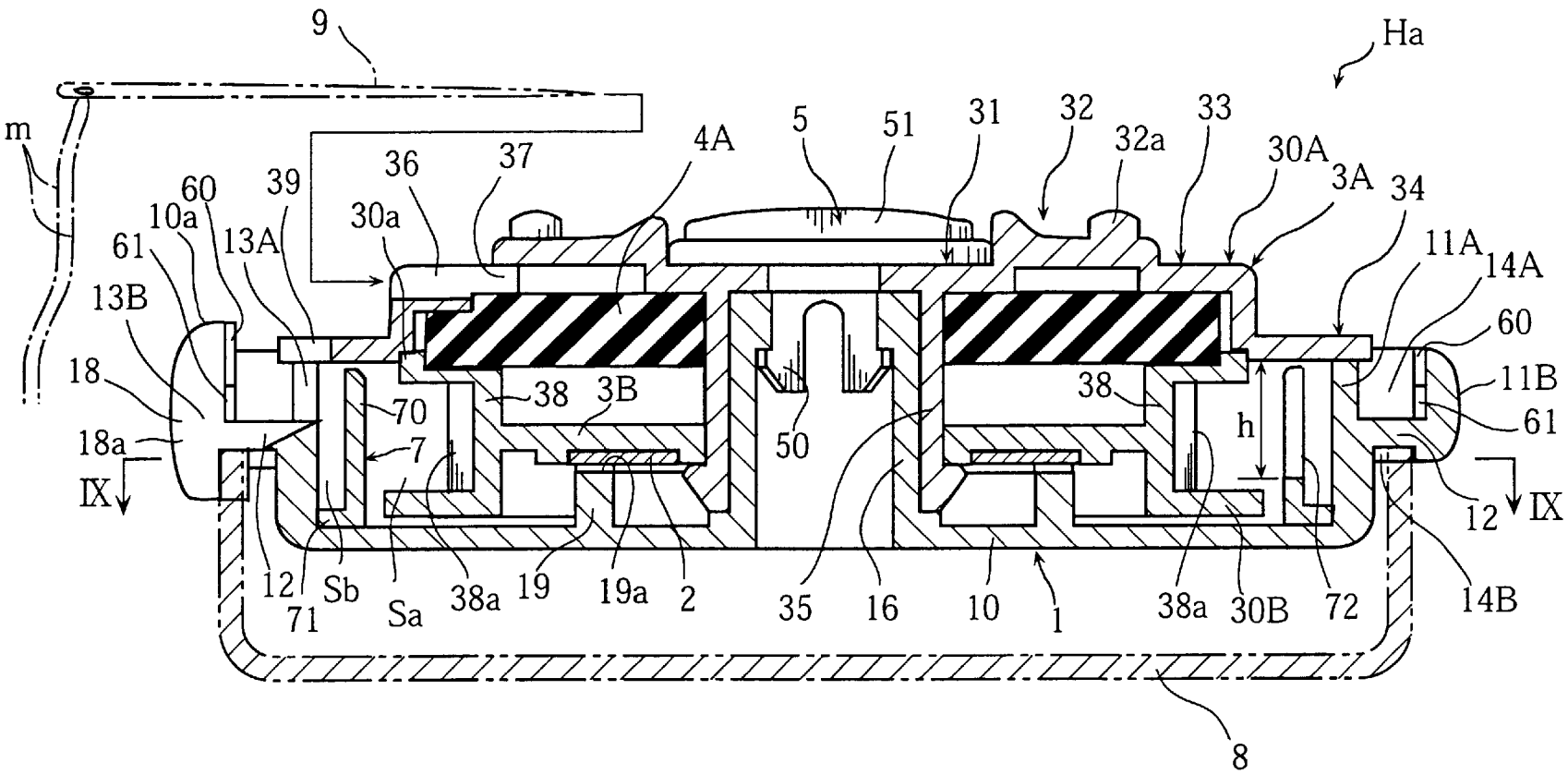
FIG. 8 is a sectional view showing a holder for sewing needles according to a second embodiment of the present invention.
Figure 9:
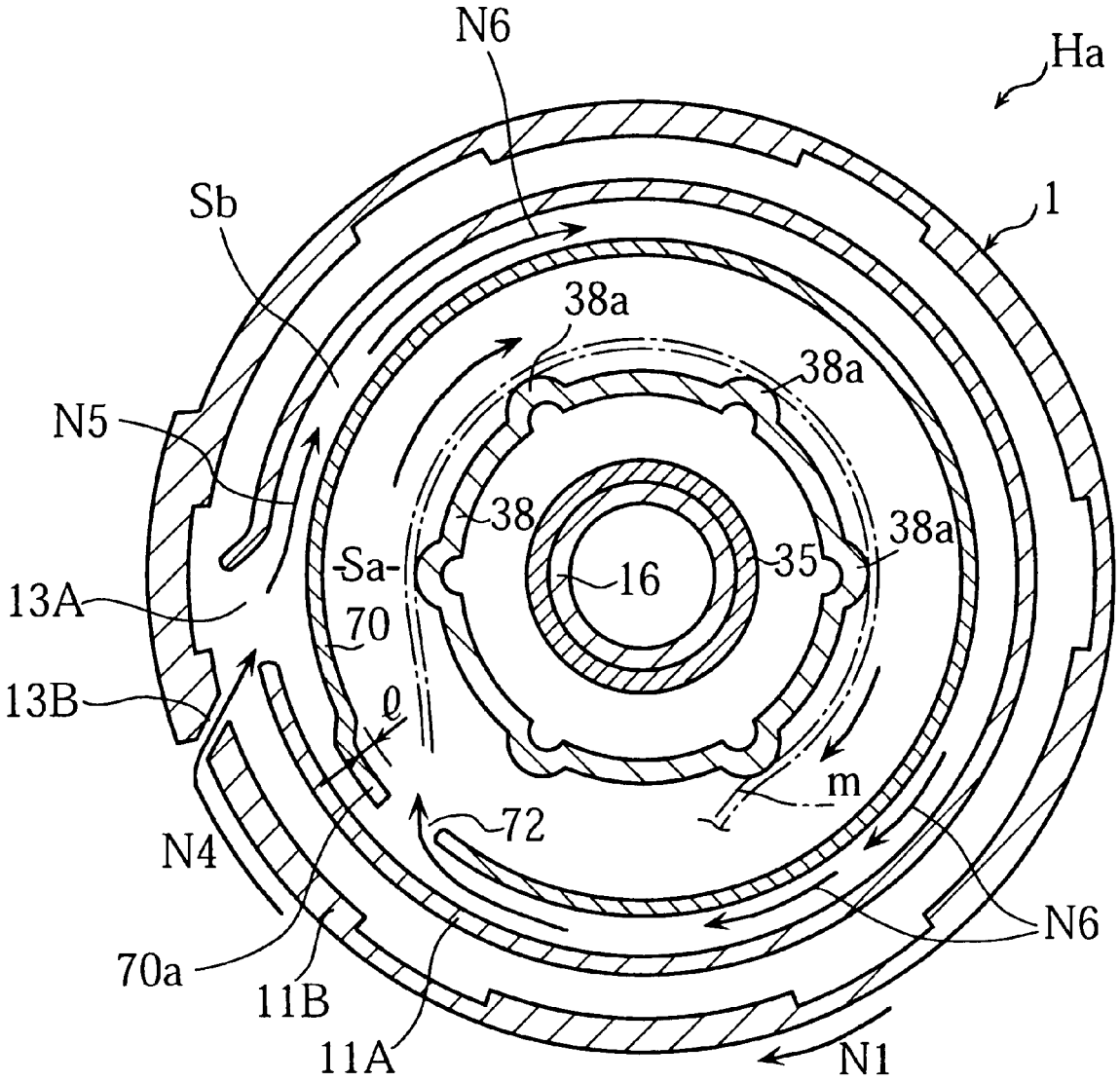
FIG. 9 is a sectional view of the holder of FIG. 8, in which the passage of the thread is indicated by arrows.

FIG. 8 is a sectional view illustrating a sewing needle holder Ha according to a second embodiment of the present invention, whereas FIG. 9 is a sectional view of the sewing needle holder Ha taken along lines IX—IX in FIG. 8. For the sewing needle holder Ha, elements similar to those of the sewing needle holder H according to the first embodiment are indicated by the same references. No detailed description will be given to these elements.

One of the differences between the two holders according to the first and the second embodiments is that the holder Ha of the second embodiment includes an inner wall 70 between an intermediate wall 11A and a winding member 38 (see FIGS. 8–9). The inner wall 70 is an element of a ring member 7 shown in FIG. 10. The ring member 70 includes a circular flanged portion 71 from which the inner wall 70 upwardly extends.

Figure 10:
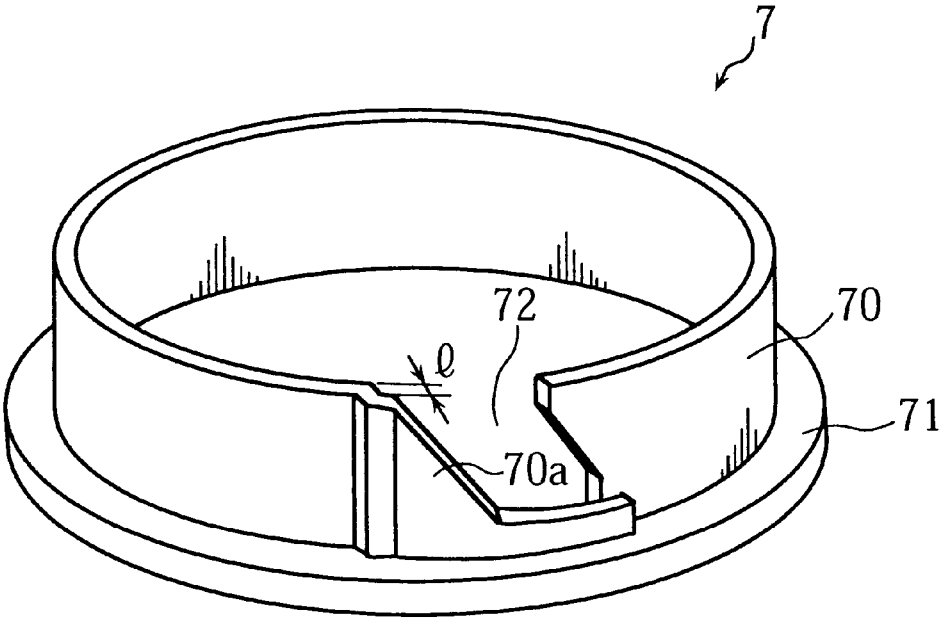
FIG. 10 is a perspective view showing a ring member used for the holder of FIG. 8.

As shown in FIG. 10, the inner wall 70 is formed with a guiding groove 72. The guiding groove 72 is partly defined by a circumferential end portion 70*a* of the wall 70 that is outwardly offset by a predetermined distance l relative to the other circumferential end portion.

As shown in FIG. 8, the ring member 7 is fixed to the bottom of the base 1 via an adhesive for example, with the inner wall 70 located between the intermediate wall 11A and the winding member 38. In the holder Ha of the second embodiment, a winding space Sa for the thread is defined between the inner wall 70 and the winding member 38, while an auxiliary space Sb is defined between the inner wall 70 and the intermediate wall 11A. The auxiliary space Sb provides a passage through which the thread m is moved before it enters the winding space Sa.

As best shown in FIG. 9, the guiding groove 72 is circumferentially offset from the first groove 13A. Thus, the guiding groove 72 and the first groove 13A are arranged in non-facing relation. As shown in FIG. 8, the vertical length h of the guiding groove 72 is made greater than those of the first groove 13A and the second groove 13B. Further, the lower end of the guiding groove 72 is almost at the same level as the lower end of the winding member 38.

Another difference between the first and the second embodiments resides in that the radially outer surface of the winding member 38 is provided with a plurality of raised portions 38*a*. These raised portions are equally spaced from each other at suitable circumferential intervals and extend axially of the winding member 38. Another difference between the two embodiments is that the holder Ha of the second embodiment includes a pin cushion 4A supported by an upper flanged portion 30*a* of the spool 3B. In this way, the pin cushion 4A is advantageously reduced in thickness.

The function of the holder Ha having the above arrangement will be described. When the reel is rotated in the N1-direction (see FIG. 9) with a thread-attached needle 9 stuck into the cushion 4A, the thread m of the needle is successively passed through the second groove 13B and the first groove 13A, and introduced into the auxiliary space Sb, as indicated by arrows N4 and N5. With further rotation of the reel in the same direction, the thread m is moved along the outer surface of the auxiliary wall 70 as indicated by arrows N6, and brought to the guiding groove 72. Then, the the thread m is introduced into the winding space Sa via the guiding groove 72. Thereafter, the thread m is wound around the winding member 38 with the raised portions 38*a*.

With the above arrangement, the thread m is advantageously stretched while it is passing through the auxiliary space Sb. Thus, the subsequent winding of the thread m around the winding member 38 is properly performed. Therefore, even when several needles with thread are carried by the holder Ha, the thread of a desired needle can be smoothly drawn out.

Figure 11:
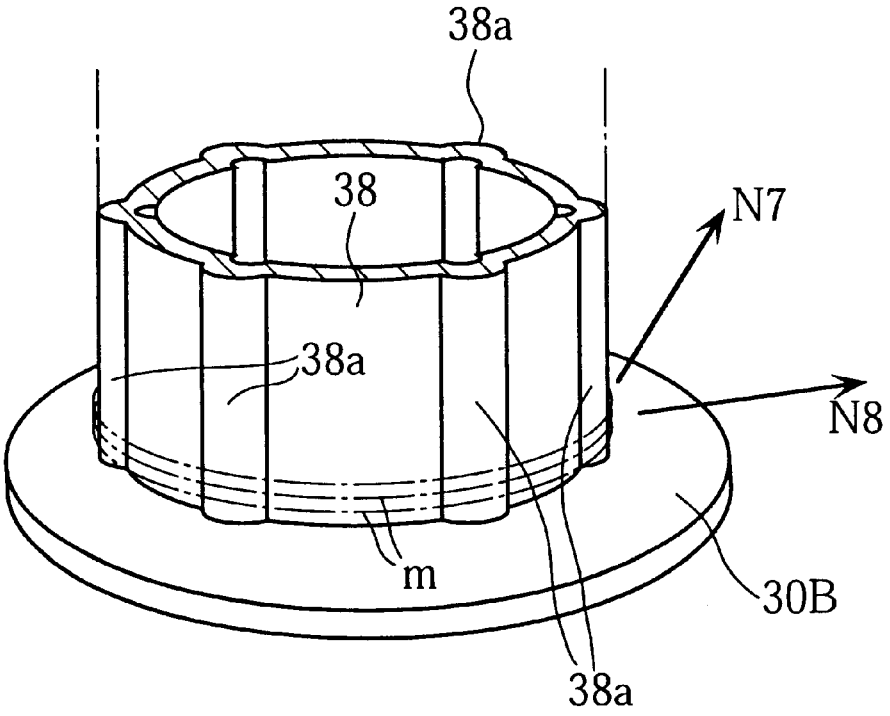
FIG. 11 is a perspective view showing a winding member used for the holder of FIG. 8.

Further, the lower end of the guiding groove 72 is located adjacent to the lower end of the winding member 38. Thus, it is possible to wind the thread m around a lower portion of the winding member 38, as shown in FIG. 11. In this instance, when the wound thread m is pulled, the pulling force is exerted in a direction indicated by an arrow N7. Such an arrangement is remarkably advantageous in performing the pulling-out of the wound thread m in a remarkably smooth manner.

Specifically, if the thread is pulled in the N8-direction, the friction between the thread and the outer surface of the winding member 38 is comparatively large. The friction becomes much greater when a plurality of pieces of thread are wound together on the winding member 38. However, according to the present invention, since the pulling force is exerted in the N7-direction, the wound thread m can be drawn out more smoothly.

As previously described in connection with FIG. 8, the guiding groove 72 has a comparatively great length h in the vertical direction. On the other hand, the first groove 13A and the second groove 13B have smaller vertical lengths. Thus, according to the present invention, dust is substantially prevented from going into the holding body Ha via the first and second grooves 13A, 13B.

Further, in the holder Ha according to the second embodiment, the tread m wound around the winding member 38 is held in contact with the apex of each raised portion 38*a* only. In other words, the wound thread m is outwardly spaced from the outer surface portions between the raised portions 38*a*. Thus, the contact area or contact length of the thread m with the winding member 38 is reduced. Therefore, the pulling-out of the thread m is much more smoothly performed.

The preferred embodiments of the present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

I claim:

1. A holder for sewing needles each being coupled with thread, the holder comprising:

a reel including an end plate and a winding member for winding the thread thereon, the winding member extending from the end plate;

a retaining member for positioning said each needle relative to the end plate; and a base supporting the reel for rotational movement, the base being provided with a first wall enclosing but spaced from the winding member to provide a clearance therebetween;

wherein the first wall is formed with a first opening through which the thread of said each needle is brought into the clearance while the reel is rotated.

2. The holder according to claim 1, wherein the end plate includes a flanged portion formed with cutouts for receiving the thread of the needles.

3. The holder according to claim 1, wherein the first wall includes first and second end portions flanking the first opening, the rotational movement of the reel being performed along the first end portion, the first opening and the second end portion in this order, the second end portion being bent in a radially outward direction.

4. The holder according to claim 1, further comprising restricting means for permitting the reel to rotate in one direction only.

5. The holder according to claim 4, wherein the restricting means includes a ratchet mechanism.

6. The holder according to claim 1, wherein the retaining member includes a pin cushion held within the reel.

7. The holder according to claim 1, wherein the end plate of the reel is provided with a plurality of thread-guiding grooves each having a bore to communicate with the retaining member.

8. The holder according to claim 7, wherein each thread-guiding groove has a longitudinal axis positionally deviated from a radial direction of the reel.

9. The holder according to claim 1, wherein the end plate of the reel is diametrically greater than the first wall.

10. The holder according to claim 2, wherein each cutout of the flanged portion extends radially inward beyond the first wall.

11. The holder according to claim 1, wherein the winding member of the reel is provided with a plurality of raised portions each extending axially of the winding member.

12. The holder according to claim 1, wherein the base further comprises an inner wall between the first wall and the winding member, the inner wall being formed with a guide opening which is circumferentially deviated from the first opening of the first wall.

13. The holder according to claim 1, further comprising a protection cover releasably attached to the base.

14. The holder according to claim 13, wherein the base further comprises an outer wall enclosing but spaced outward from the first wall, the protection cover being attached to the base between the outer wall and the first wall.

15. The holder according to claim 14, wherein the outer wall is formed with a second opening for the thread.

* * * * *